US011278752B2

(12) United States Patent
Walker

(10) Patent No.: US 11,278,752 B2
(45) Date of Patent: Mar. 22, 2022

(54) HEALTH AND SAFETY UNIT

(71) Applicant: First Reaction Ltd., Portadown (GB)

(72) Inventor: Jason Walker, Portadown (GB)

(73) Assignee: First Reaction Ltd., Portadown (GB)

( * ) Notice: Subject to any disclaimer, the term of this patent is extended or adjusted under 35 U.S.C. 154(b) by 0 days.

(21) Appl. No.: 16/099,872

(22) PCT Filed: May 8, 2017

(86) PCT No.: PCT/IB2017/052674
§ 371 (c)(1),
(2) Date: Nov. 8, 2018

(87) PCT Pub. No.: WO2017/195096
PCT Pub. Date: Nov. 16, 2017

(65) Prior Publication Data

US 2019/0126080 A1 May 2, 2019

(30) Foreign Application Priority Data

May 9, 2016 (GB) ..... 1608087

(51) Int. Cl.
*A62C 13/78* (2006.01)
*A62C 3/00* (2006.01)
(Continued)

(52) U.S. Cl.
CPC ..... *A62C 13/78* (2013.01); *A47B 88/42* (2017.01); *A62C 3/006* (2013.01); *A47B 77/04* (2013.01)

(58) Field of Classification Search
CPC ..... A62C 13/78; A62C 3/006; A47B 88/42; A47B 77/04
(Continued)

(56) References Cited

U.S. PATENT DOCUMENTS 825,774 A * 7/1906 Stumm
827,649 A * 7/1906 Murphy
(Continued)

FOREIGN PATENT DOCUMENTS

CN 202143758 U 2/2012
CN 102610053 A 7/2012
(Continued)

OTHER PUBLICATIONS

PCT International Search Report and Written Opinion dated Jul. 26, 2017 for International Application No. PCT/IB2017/052674, 9 pages.
(Continued)

*Primary Examiner* — Daniel J Troy
*Assistant Examiner* — Timothy M Ayres
(74) *Attorney, Agent, or Firm* — RMCK Law Group, PLC

(57) ABSTRACT

A health and safety unit according to the present disclosure can include a vertically arranged panel having a first side and a second side opposite the first side and a mounting structure for movably mounting the panel to a housing. The panel can define a plurality of pockets extending through the first and second sides. Each of the plurality of pockets can be dimensioned to receive and support one or more items for storing within the housing. The panel, when movably mounted to the housing by the mounting structure, can be movable between a first position and a second position, wherein the panel and any items received therein are enclosed within the housing in the first position, and wherein the panel and any items received therein are accessible in the second position such that the one or more items can be removed from the plurality of pockets for use.

20 Claims, 12 Drawing Sheets

(51) Int. Cl.
*A47B 88/42* (2017.01)
*A47B 77/04* (2006.01)

(58) Field of Classification Search
USPC ..... 312/348.3, 330.1
See application file for complete search history.

(56) References Cited

U.S. PATENT DOCUMENTS 1,954,384 A * 4/1934 Hurt ..... F24C 15/16 312/334.24
2,254,431 A * 9/1941 Levine ..... A47B 67/02 206/364
2,381,667 A * 8/1945 Jensen ..... F25C 1/24 62/258
2,608,305 A * 8/1952 Sager ..... A47J 47/16 211/106
3,089,745 A * 5/1963 Postula ..... A47B 53/00 312/324
D225,162 S * 11/1972 Blendl ..... D6/559
3,960,273 A * 6/1976 Weston ..... A47F 7/0246 211/4
4,008,807 A * 2/1977 Phillips ..... A47F 7/08 211/34
4,125,305 A * 11/1978 Kasindorf ..... E05B 65/46 312/233
D262,274 S * 12/1981 Lahr ..... 47/82
4,377,241 A * 3/1983 Schreiner ..... A47F 5/0025 108/55.1
4,482,065 A * 11/1984 Altemose ..... A47B 73/00 211/74
4,548,274 A * 10/1985 Simpson ..... A62C 35/02 169/51
4,784,446 A * 11/1988 Newhouse ..... A47B 67/04 312/249.8
4,892,367 A * 1/1990 Jantzen ..... A47B 49/002 312/296
4,898,281 A * 2/1990 Cherry ..... A45D 29/20 211/126.1
4,960,307 A 10/1990 Nelsen
4,984,854 A * 1/1991 DeLavallade ..... A47F 3/08 211/1.3
5,458,409 A * 10/1995 Sheng ..... A47F 3/063 29/434
5,518,074 A * 5/1996 Brotherson ..... A62C 3/006 169/50
5,793,280 A * 8/1998 Hincher ..... A62C 13/78 169/51
D400,361 S * 11/1998 Sobrito ..... D6/332
5,853,092 A * 12/1998 Goodman ..... A47F 5/0823 211/70.6
5,921,645 A * 7/1999 Lapi ..... A62C 13/78 206/397
5,975,475 A * 11/1999 Chaplin ..... A62C 13/78 169/51
6,124,796 A * 9/2000 Hincher ..... G08B 7/06 340/321
6,135,584 A * 10/2000 Happ ..... B25H 3/028 312/330.1
6,726,296 B2 * 4/2004 McGilton ..... A47B 77/06 312/228
6,729,481 B1 * 5/2004 O'Brien ..... A47B 73/00 211/74
8,550,243 B2 * 10/2013 Moore ..... A45C 13/02 206/315.1
8,779,906 B2 * 7/2014 Manning ..... G08B 15/02 340/321
9,499,269 B2 * 11/2016 Ivester ..... B64C 1/066
9,682,260 B2 * 6/2017 Harder ..... A62C 8/06
9,877,436 B1 * 1/2018 Taylor ..... A01G 22/00
10,383,464 B2 * 8/2019 Morin ..... A47G 7/044
2003/0000864 A1 * 1/2003 Carraro ..... A62C 13/78 206/576
2004/0100173 A1 * 5/2004 Jakob-Bamberg ..... A47B 88/42 312/330.1
2004/0188322 A1 * 9/2004 Chen ..... B25H 3/003 206/749
2004/0232810 A1 * 11/2004 Kreyenkamp ..... A47B 88/48 312/322
2005/0067924 A1 * 3/2005 Cook ..... A47B 67/02 312/245
2007/0235397 A1 * 10/2007 Wannop ..... A47B 77/16 211/81
2008/0035523 A1 * 2/2008 Lemire ..... A45C 13/005 206/774
2009/0108718 A1 4/2009 Craig et al.
2012/0217214 A1 * 8/2012 Thomsen ..... A47B 77/16 211/79
2014/0346939 A1 * 11/2014 Rickman ..... A47F 7/02 312/334.1
2015/0115786 A1 * 4/2015 Manalang ..... A47B 31/00 312/321.5

FOREIGN PATENT DOCUMENTS

CN 102895753 A 1/2013
GB 2434746 A 8/2007
JP 2011050527 A 3/2011

OTHER PUBLICATIONS

Chinese Search Report dated Apr. 15, 2020 for Chinese Application No. 201780035992.3, 2 pages.

* cited by examiner

HEALTH AND SAFETY UNIT

CROSS-REFERENCE TO RELATED APPLICATIONS

This application is a 371 U.S. National Stage of International Application No. PCT/IB2017/052674, filed May 8, 2017, which claims priority to United Kingdom Patent Application No. 1608087.1, filed on May 9, 2016. The disclosures of each of the above applications are incorporated herein by reference in their entirety.

FIELD

This disclosure relates to a health and safety unit for providing emergency equipment and information in a readily accessible location in a location such as a room, in particular but not limited to, a kitchen or galley.

BACKGROUND

With health and safety incidents such as fires, medical emergencies and accidents still a common occurrence, it is beneficial to provide readily accessible equipment to enable individuals to deal with them.

There is a particular fire risk in the home, due to such activities as cooking over open flames and the risk of oil fires due to chip pans and deep fat fryers. In order to respond to an incident such as this it is known to provide fire blankets to enable chip pan fires to be extinguished and it is also known to provide fire extinguishers in the house to enable small fires to be dealt with by the occupant. Although different, medical emergencies often require the provision of equipment to deal with particular issues, such as a defibrillator, a nebulizer, or more simply a health and safety kit with bandages and plasters. However, such equipment is only required very rarely and thus may not be stored in an immediately accessible location that is readily available when required in an emergency.

SUMMARY

According to the present disclosure there is provided a health and safety unit adapted for movable mounting with respect to a housing, the health and safety unit comprising a storage means for storing one or more items for use in an emergency, wherein said items may comprise one or more of a fire extinguisher, a first aid kit, or a fire blanket, nebulizer, defibrillator wherein the storage means comprises a holder having plurality of mounting means for mounting said plurality of items within the storage means, wherein the mounting means comprises a plurality of recesses or pockets, each recess or pocket being dimensioned to receive and support a respective one of said one or more items for use in an emergency, and wherein said health and safety unit is movable between a first position wherein said holder, and the items mounted therein, are enclosed within the housing, and a second position, wherein said plurality of items can be removed from the holder for use.

Conveniently, the first position is a closed or stowed position and the second position is an open or deployed position.

In this way, the items of equipment for use in an emergency are maintained in and retrievable from, a single dedicated location.

Optionally, the health and safety unit further comprises one or more of a torch, an escape hammer, a burns kit, or other item or items that might be required in an emergency.

In some aspects the health and safety unit further comprises safety information, such as a fire escape plan and/or instructions on the use of the plurality of items included therein.

In some aspects, the health and safety unit is slidably mountable with respect to the housing in the manner of a drawer.

Optionally, the health and safety unit is slidably mounted to the housing on slidable rails or ball bearing rollers.

In one embodiment the holder comprises a vertically arranged panel mounted to be slid in and out of the housing in use in a substantially horizontal direction, said panel having a front face defining a portion of the front face of the housing when the health and safety unit is in its first position.

In some aspects at least one of said mounting means is arranged to enable the respective item located therein to be accessible from both sides of the panel. The panel can include an aperture within which said item can be located when mounted in the respective mounting means to enable the item to be accessible from either side of the panel. Said item may comprise a fire extinguisher.

In some embodiments the holder comprises a drawer slidably mountable within the housing, wherein said plurality of mounting means comprises a plurality of recesses or depressions provided in the base of the drawer, e.g., within a moulded panel located within the drawer, for receiving said plurality of items.

In some aspects the holder may comprise a door, said plurality of mounting means being provided on a rear face of the door such that said items are accessible when the door is opened and are enclosed within the housing when the door is closed.

Optionally, embodiments of the fire safety unit are provided with one or more smoke and/or heat detectors that is/are in communication with a means operable to automatically deploy the safety unit from its housing upon activation of the smoke and/or heat detectors.

Conveniently, the smoke and/or heat detector and the means operable to automatically deploy the safety unit are powered by one or more batteries located on or within the fire safety units.

Optionally, the means operable to automatically deploy the safety unit from its housing comprises a motor.

Optionally, embodiments of the fire safety unit are provided with an audible alarm that is activated in use in response from a signal from the one or smoke and/or heat detectors.

Optionally, embodiments of the fire safety unit are provided with a visible alarm such as a flashing light that is activated in use in response from a signal from the one or smoke and/or heat detectors.

Optionally, embodiments of the fire safety unit are provided with a visible alarm means such as one or more flashing lights that is/are activated in use in response from a signal from the one or smoke and/or heat detectors.

Optionally, embodiments of the health and safety unit are provided with one or more symbols identifying the health and safety unit and distinguishing it from other furniture or equipment.

Optionally, embodiments of the fire safety unit are provided with a remote communication means that is in communication with the one or more smoke and/or heat detectors such that upon activation of the one or more smoke and/or heat detectors, a message or signal is sent from the remote communication means to a remote device so that a person or subscriber is alerted of activation of the fire safety unit. In some aspects the remote communication means is a wireless communications means such as, but not limited to, Bluetooth, SMS, etc.

Optionally, the housing is a kitchen unit or kitchen cabinet.

In some aspects, a health and safety unit according to the present disclosure can include a vertically arranged panel having a first side and a second side opposite the first side and a mounting structure for movably mounting the panel to a housing. The panel can define a plurality of pockets extending through the first and second sides. Each of the plurality of pockets can be dimensioned to receive and support one or more items for storing within the housing. The panel, when movably mounted to the housing by the mounting structure, can be movable between a first position and a second position, wherein the panel and any items received therein are enclosed within the housing in the first position, and wherein the panel and any items received therein are accessible in the second position such that the one or more items can be removed from the plurality of pockets for use.

The preceding discussion of the background to the disclosure is intended only to facilitate an understanding of the present disclosure. It should be appreciated that the discussion is not an acknowledgement or admission that any of the material referred to was part of the common general knowledge as at the priority date of the application.

Throughout the description and claims of this specification, the words "comprise" and "contain" and variations of those words, for example "comprising" and "comprises", mean "including but not limited to", and are not intended to (and do not) exclude other components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect, embodiment or example of the disclosure are to be understood to be applicable to any other aspect, embodiment or example described herein unless incompatible therewith.

BRIEF DESCRIPTION OF THE DRAWINGS

Embodiments of the present disclosure will now be described, by way of example only, with reference to the accompanying drawings, in which.

DETAILED DESCRIPTION

The present disclosure provides a health and safety unit which will conveniently house, e.g., a fire extinguisher, a fire blanket, a first aid kit and a health and escape plan. The unit may be adapted to form part of a fitted kitchen, comprising a pull out holder or drawer having specially shaped recesses or pockets for storing the fire extinguisher, fire blanket and first aid kit in a readily accessible location.

The unit may be adapted to receive said items in such a manner that no other objects can be placed into the unit to cause an obstruction. The unit may be designed so that the fire extinguisher, the fire blanket and the first aid kit can be accessed from both sides, thus making it easier to remove such items from the unit in the case of an emergency more easily, more conveniently and more quickly, which means the user has more time to tackle the incident etc.

The unit may incorporate a moulded compartment for receiving the fire extinguisher, and for holding the fire extinguisher in place. The unit may also be adapted to hold a fire escape plan and other pieces of important information such as instructions on how to use the safety equipment.

Figure 12:
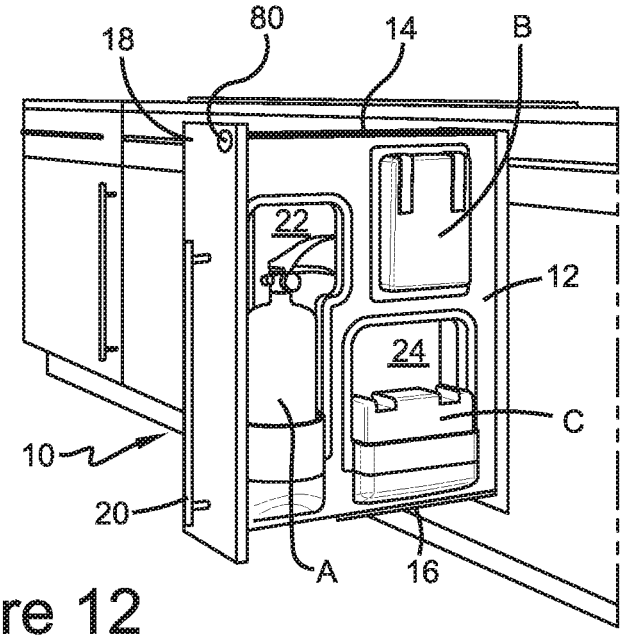
FIG. 12 shows the health and safety unit of FIG. 1 shown with respect to a housing and with items for use in an emergency located within said unit.

A health and safety unit in accordance with some embodiments of the present disclosure is illustrated in FIGS. 1 to 4 and FIG. 12. With reference to FIG. 12, the unit comprises a storage device having a fire extinguisher (A), a fire blanket (B), a first aid kit (C) and fire safety information (not shown), such as a fire escape plan and instructions for the use of the fire extinguisher, fire blanket and the first aid kit mounted therein. In FIGS. 1 to 4, the fire extinguisher, fire blanket and first aid kit are omitted for clarity.

In the first embodiment, the health and safety unit comprises a vertically mounted pull out drawer 10 comprising a vertically arranged panel 12 having drawer runners 14,16 mounted on the upper and lower ends of the panel 12 whereby the drawer 10 is mounted to be slidable into and out of a housing as shown in FIG. 12. The housing may form part of a kitchen unit or kitchen cabinet as shown in FIG. 12.

A front facing panel 18 is mounted on a front side of the panel 12 to form a closure panel of the unit, a handle 20 being mounted on said front face to allow the drawer to be opened and closed.

The panel 12 is provided with first and second apertures 22, 24, the first aperture 22 being dimensioned to receive a fire extinguisher (A) and the second aperture 24 being dimensioned to receive a first aid kit (C), the first aid kit comprising a box containing a plurality of first aid items, such as plasters, bandages and antiseptic lotions. A respective tray or receiving pocket 26, 28 is provided in a lower region of each aperture 22, 24, each tray or pocket 26, 28 being dimensioned to receive a lower end of the respective item to be mounted within the respective aperture 22, 24.

Figure 1:
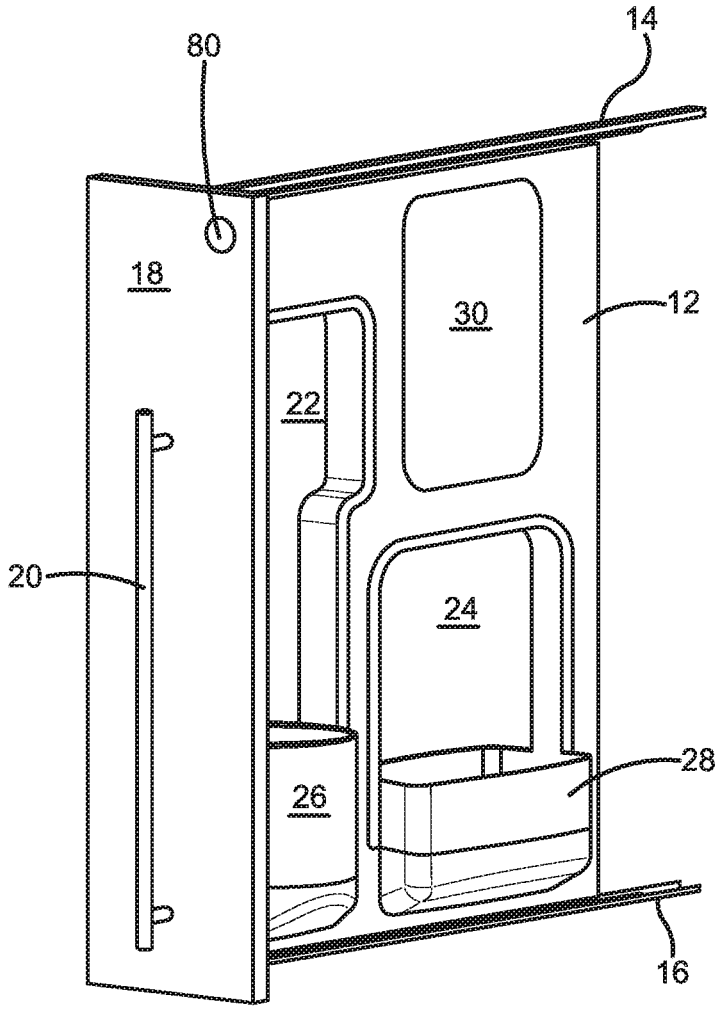
FIG. 1 is a perspective view of a health and safety unit according to some embodiments of the present disclosure.
Figure 2:
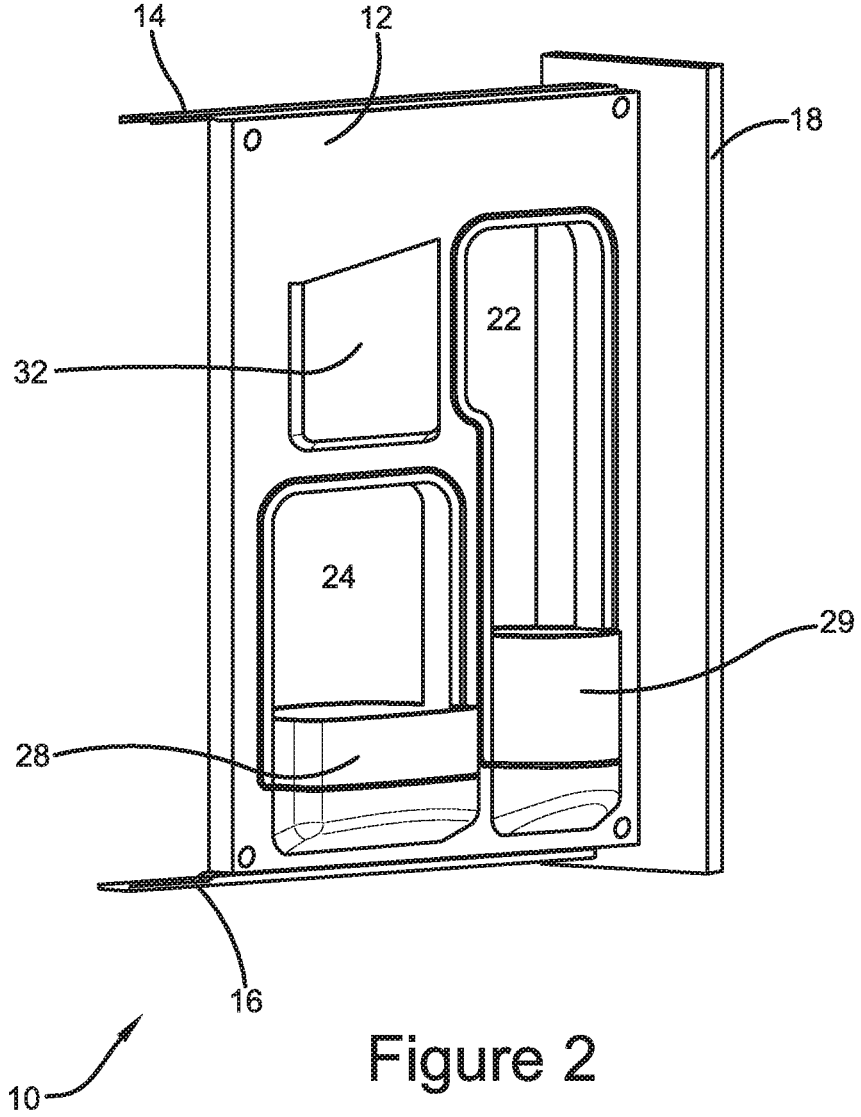
FIG. 2 is a further perspective view of the reverse side of the unit of FIG. 1.
Figure 3:
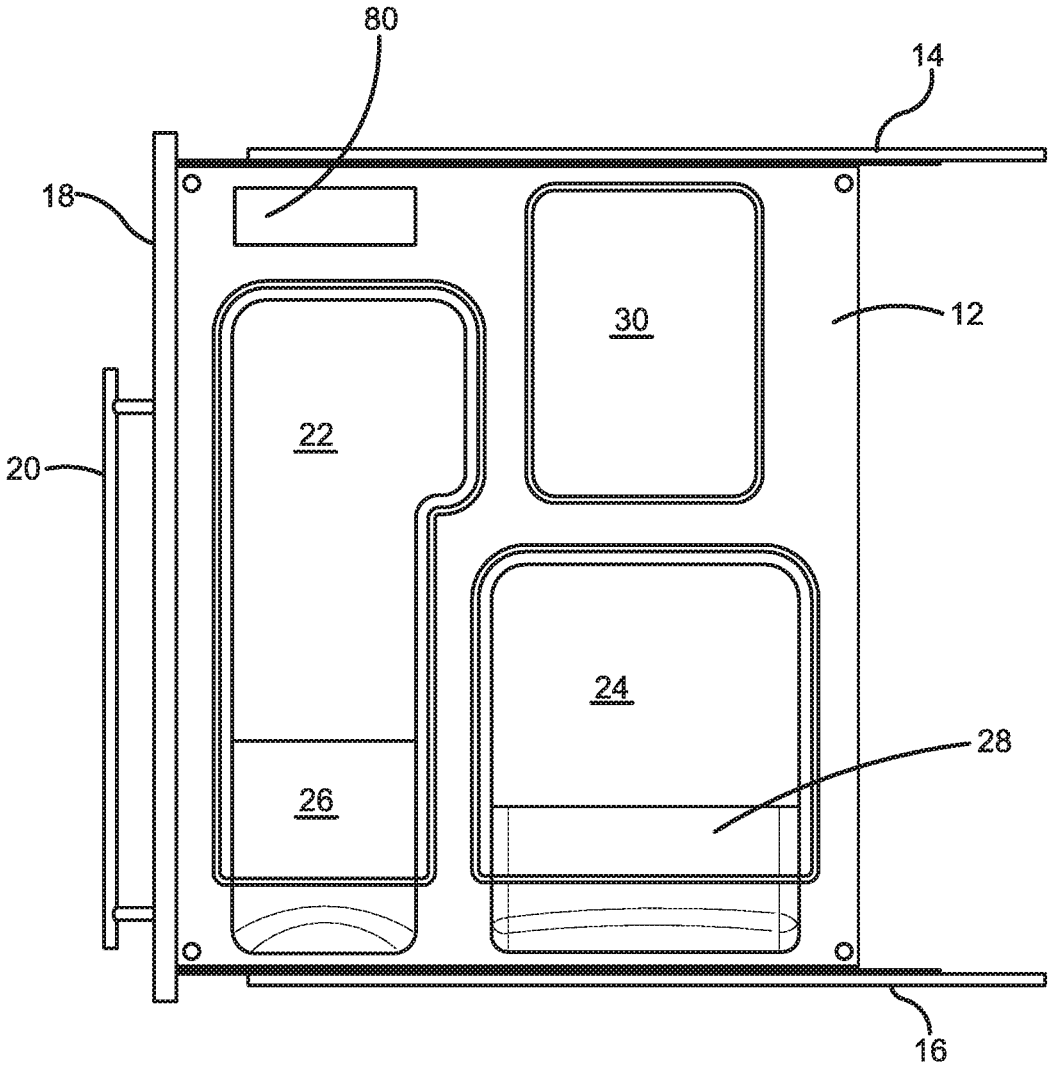
FIG. 3 is a side view of the unit of FIG. 1.
Figure 4:
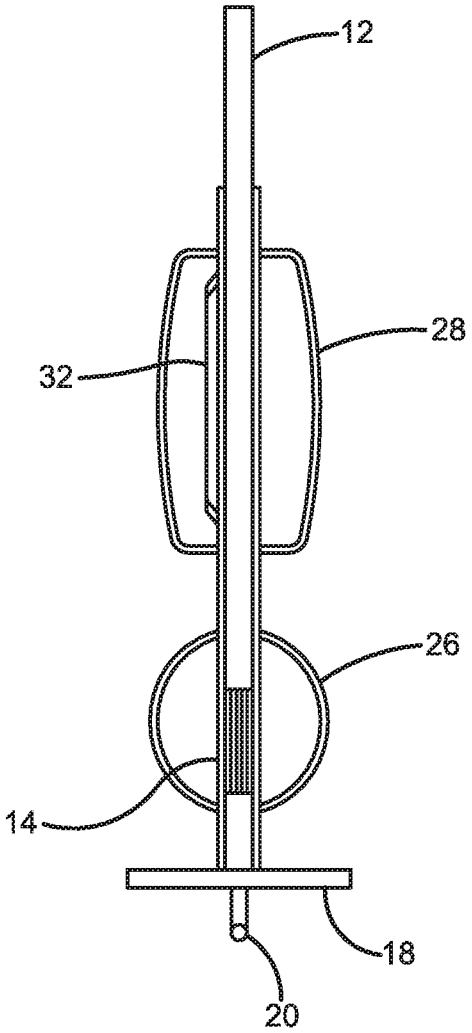
FIG. 4 is a plan view of the unit of FIG. 1.
Figure 5:
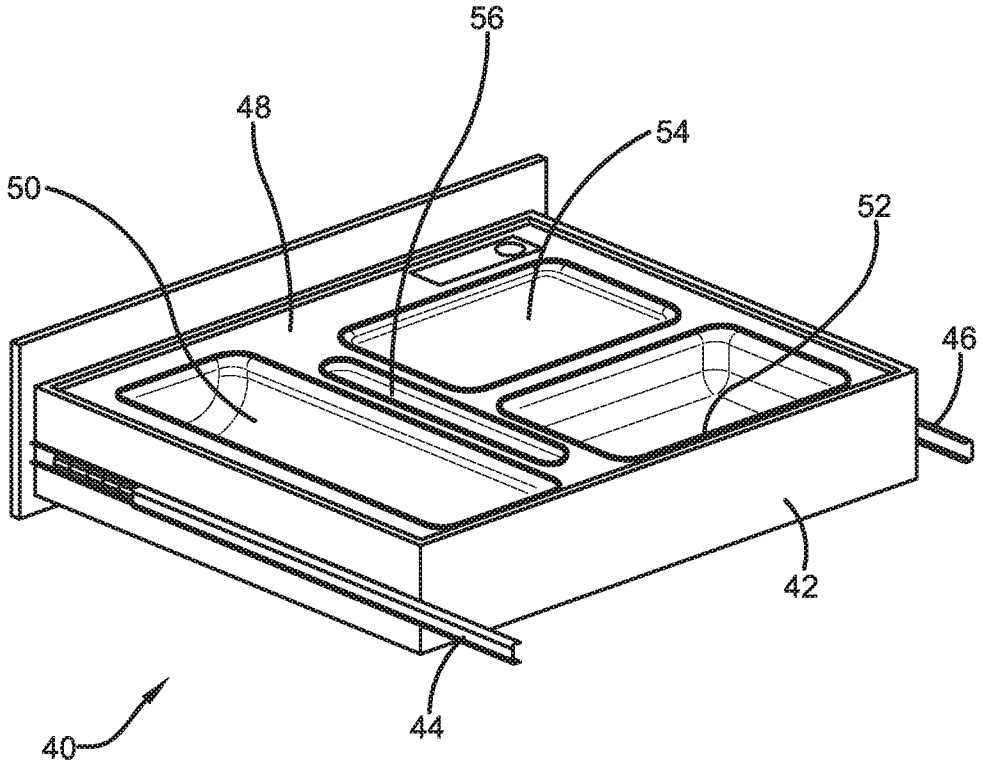
FIG. 5 is a perspective view of a fire safety unit according to some embodiments of the present disclosure.
Figure 6:
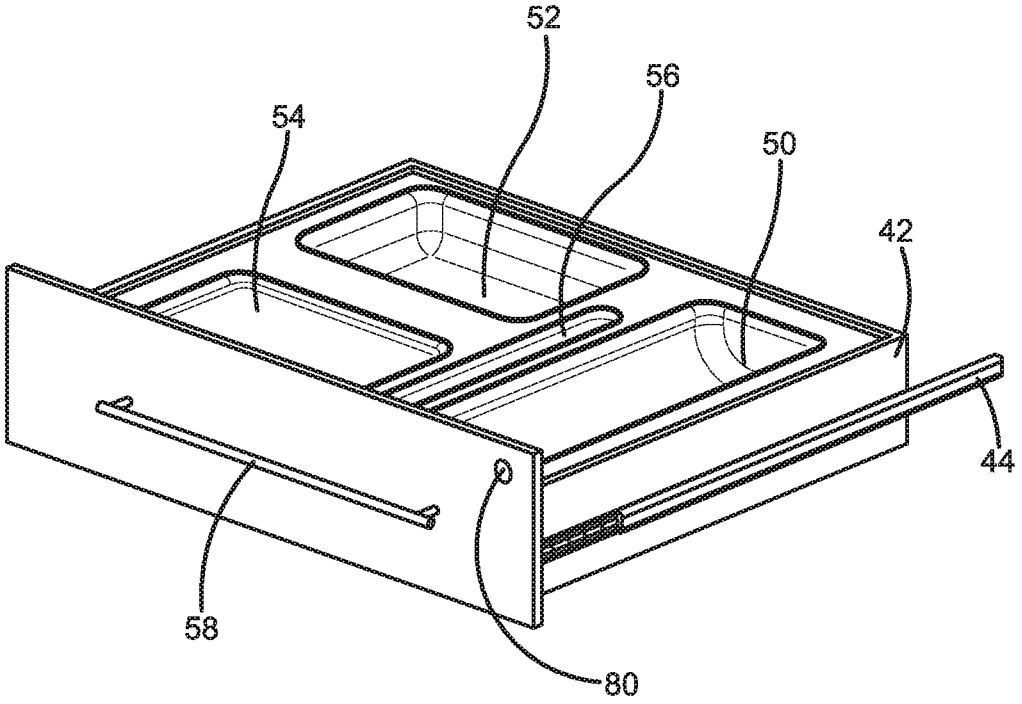
FIG. 6 is a further perspective view of the unit of FIG. 5.
Figure 7:
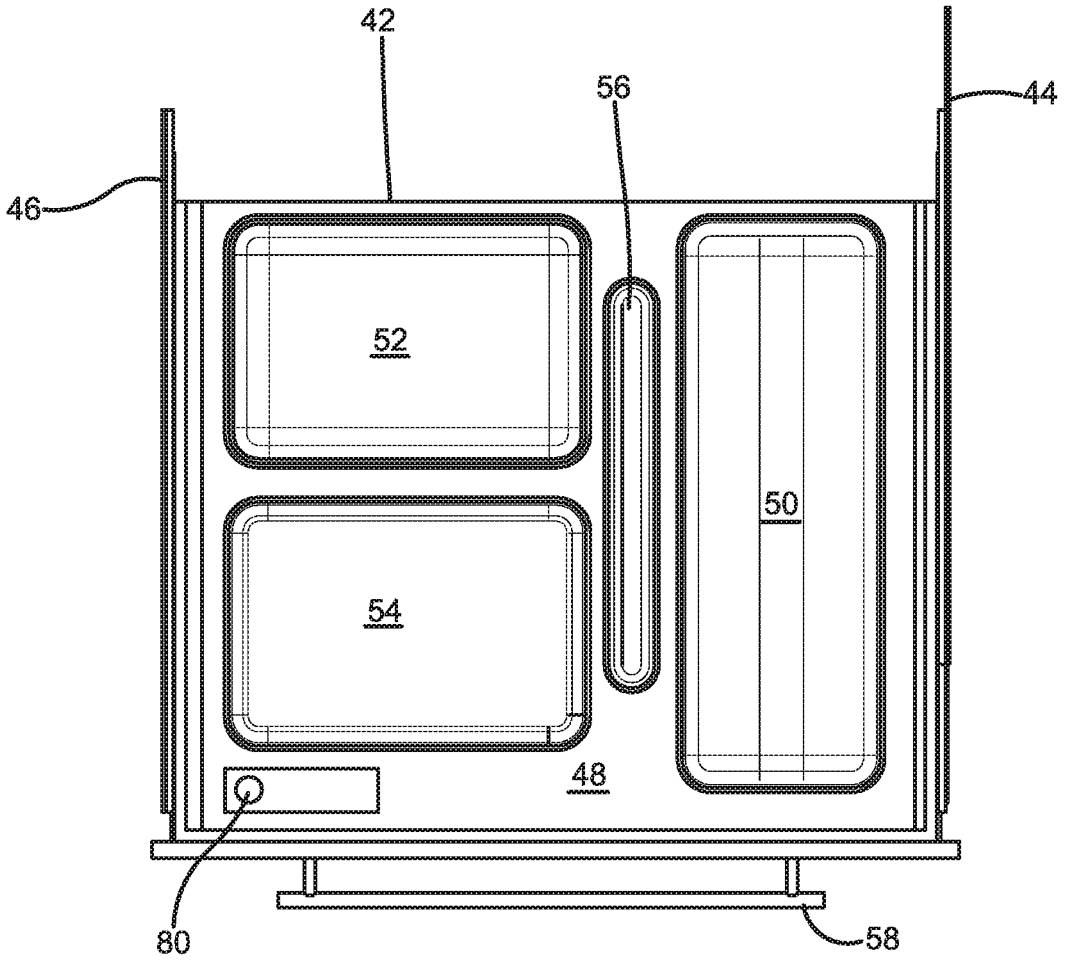
FIG. 7 is a plan view of the unit of FIG. 5.
Figure 8:
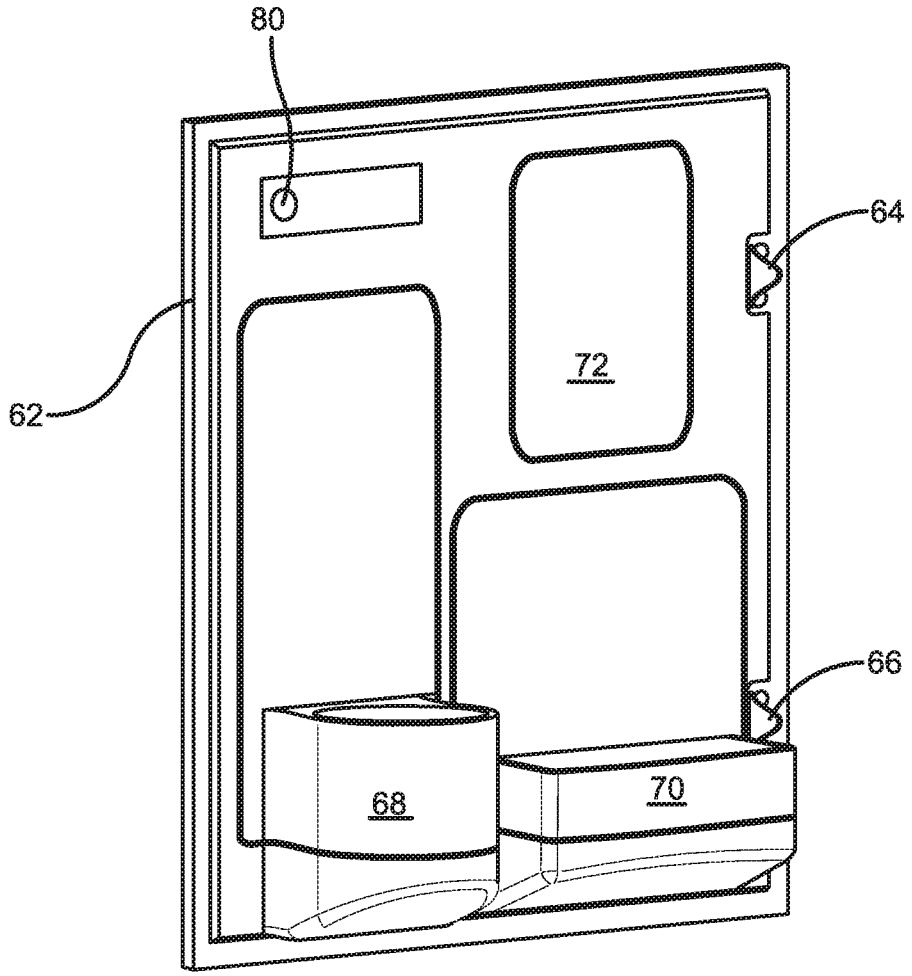
FIG. 8 is a perspective view of a fire safety unit according to additional or alternative embodiments of the present disclosure.
Figure 9:
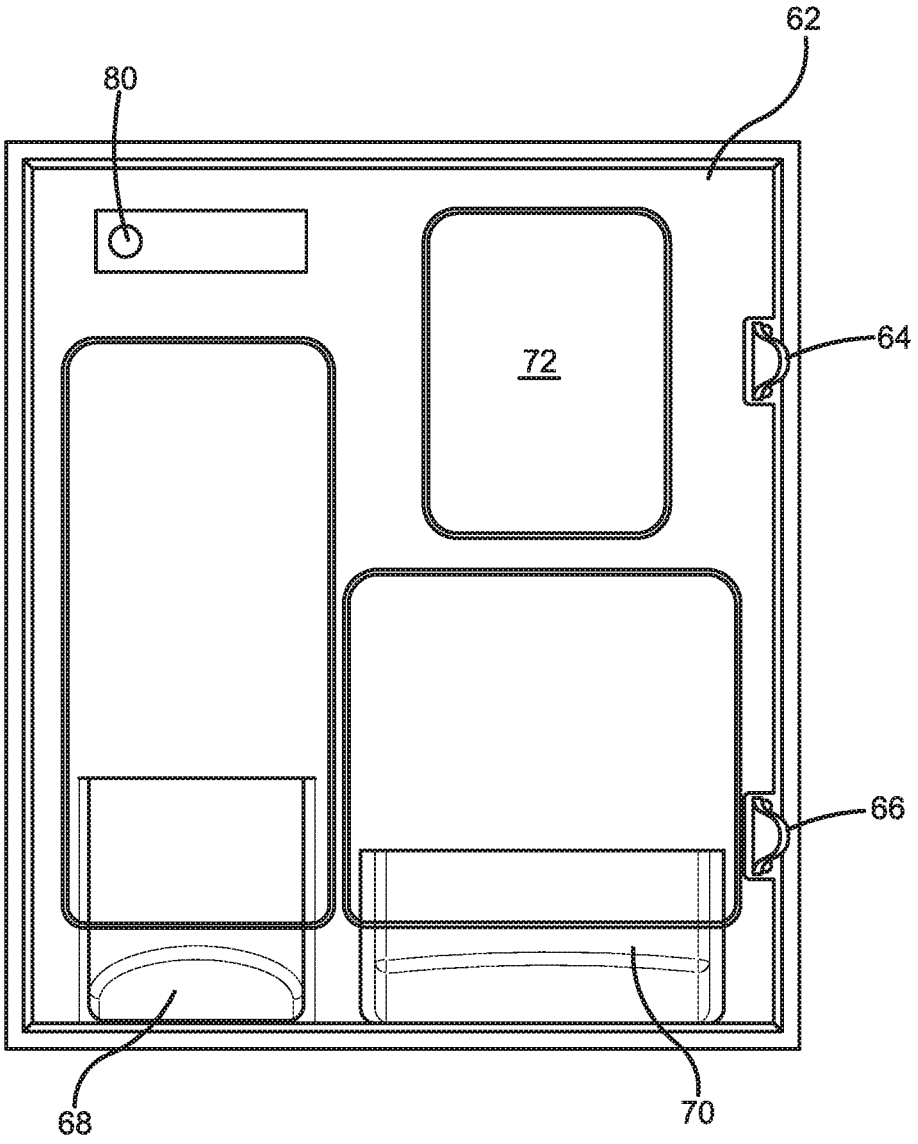
FIG. 9 is a rear view of the unit of FIG. 8.
Figure 10:
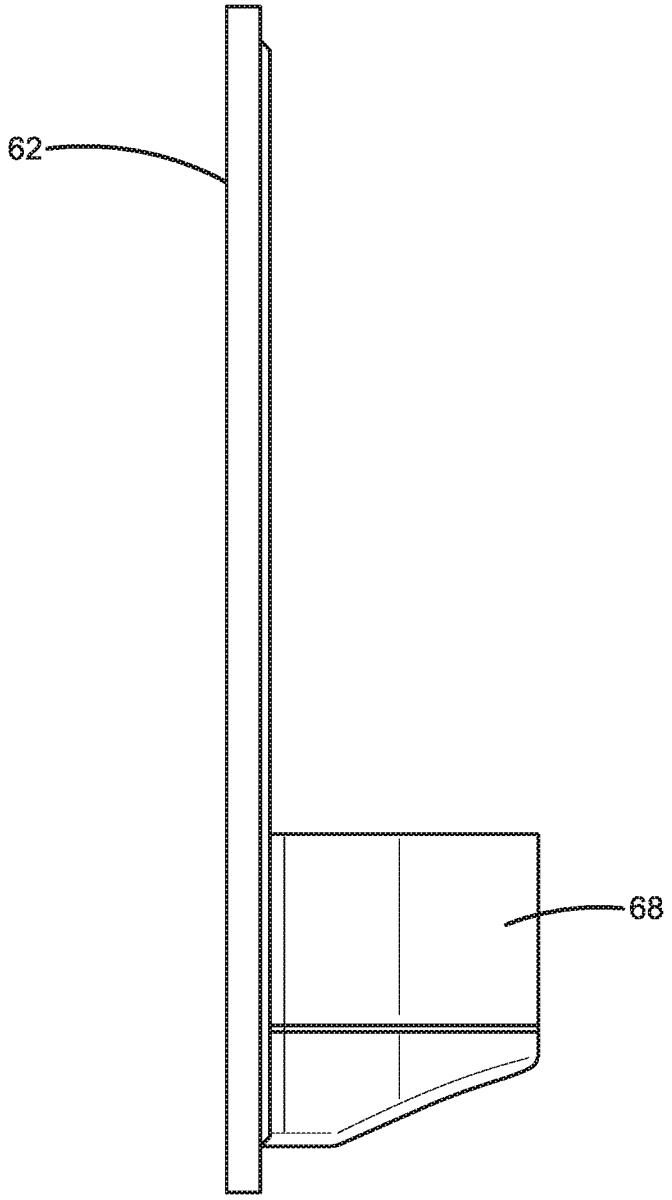
FIG. 10 is a side view of the unit of FIG. 8.
Figure 11:
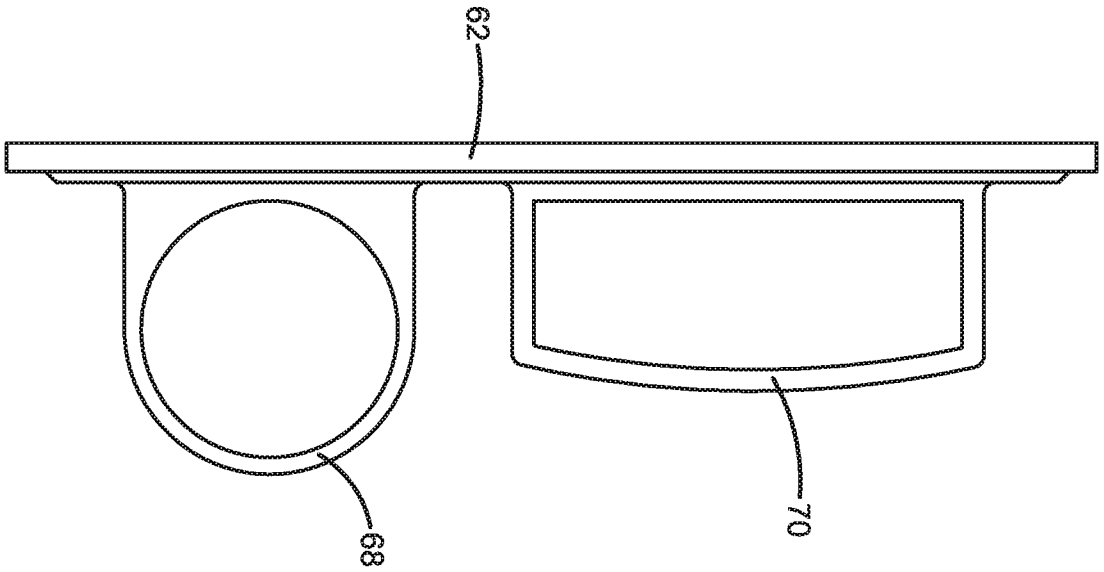
FIG. 11 is a plan view of the unit of FIG. 8.

As can be seen in FIG. 1, the panel 12 is provided with a mounting location 30 above the second aperture 24, a holder containing a fire blanket (B) (as shown in FIG. 12) being mounted on the mounting location. As shown in FIG. 2, a plastic sleeve 32 is mounted on an opposite side of the panel 12 from the fire blanket for receiving information leaflets, including a fire escape plan and instructions for the use of the fire extinguisher, fire blanket first aid, kit and other information for dealing with emergencies.

The mounting of the fire extinguisher and first aid kit within the respective pockets 26, 28 to be located within the respective recesses 22, 24 in the panel 12 as shown in FIG. 12 allows the items to be easily accessible from either side of the panel 12 when the drawer is opened.

In various embodiments, e.g., shown in FIGS. 5, 6, 7 and 13, the unit 40 comprises a horizontally mounted drawer 42 having side mounted runners 44,46 whereby the drawer 42 can be slid in and out of a housing (not shown), which may form part of a kitchen unit or cabinet.

A moulded panel 48 is mounted within the drawer 42, the panel 48 having a plurality of recesses or pockets formed therein for receiving a plurality of items comprising the fire safety unit. A first recess 50 is dimensioned to receive a fire extinguisher (A), a second recess 52 is dimensioned to receive a first aid kit (C), a third recess 54 is dimensioned to receive a fire blanket (B) and a fourth recess 56, in the form of an elongate slot, is dimensioned to receive information leaflets (D). A handle 58 is mounted on a front face of the drawer 42 to allow the drawer 42 to be pulled open.

Figure 13:
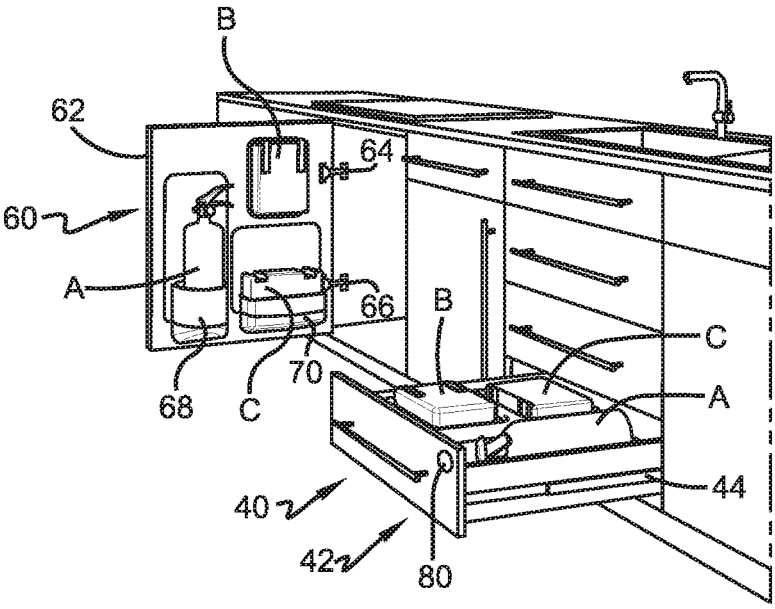
FIG. 13 shows the fire safety units of FIGS. 5 and 8 shown with respect to a housing and with items for use in an emergency located within said units.

As shown in FIG. 13, the health and safety unit may be readily retrofitted into an existing kitchen, replacing an existing drawer, or may be provided as part of a new kitchen cabinet assembly or stand alone storage assembly.

A health and safety unit 60 in accordance with additional or alternative embodiments of the present disclosure is illustrated in FIGS. 8, 9, 10, 11 and 13. The health and safety unit 60 comprises a cupboard door 62 which may be fitted to an existing kitchen cupboard or mounted on a purpose built housing or storage unit as shown in FIG. 13.

The door 62 is provided with hinge mountings 64, 66 on a rear face for mounting the door 62 onto the cupboard. Mounting pockets 68,70 are provided on a rear face of the door 62 for respectively receiving a fire extinguisher (A) and a first aid kit (C) such that the fire extinguisher and first aid kit may be mounted in the respective pockets 68,70 and supported on the rear face of the door 62.

A holder containing a fire blanket (B) (FIG. 13) is mounted on a mounting location 72 above the second pocket 70.

Embodiments of the fire safety unit may be provided with one or more smoke and/or heat detectors (not shown) that is/are in communication with a means operable to automatically deploy the safety unit from its housing upon activation of the smoke and/or heat detectors. In this way, upon detection of smoke or rising temperatures or other indicia of a fire or an imminent fire, the fire safety unit is moved from a stored position within its housing, to a deployed position externally of its housing.

To effect operation of the smoke and/or heat detectors and the means operable to automatically deploy the safety unit there is provided one or more batteries (not shown) located on or within the fire safety units. Alternatively, mains or other power sources may be used.

In some aspects, the means operable to automatically deploy the safety unit from its housing comprises a motor (not shown in the Figures). The motor is be operable on the housing or the fire safety unit rails or hinges to effect motion of the fire safety unit from a stowed position to a deployed position.

Embodiments of the fire safety unit may also be provided with an audible alarm (not shown) that is activated in use in response from a signal from the one or smoke and/or heat detectors.

Embodiments of the fire safety unit are provided with a visible alarm means such as one or more flashing lights that is/are activated in use in response from a signal from the one or smoke and/or heat detectors.

In this way, persons are alerted and directed to the fire safety unit.

Embodiments of the health and safety unit are provided with one or more symbols 80 identifying the health and safety unit and distinguishing it from other furniture or equipment.

Embodiments of the fire safety unit are provided with a remote communication means (not shown) that is in communication with the one or more smoke and/or heat detectors such that upon activation of the one or more smoke and/or heat detectors, a message or signal is sent from the remote communication means to a remote device so that a person or subscriber is alerted of activation of the fire safety unit. Such a remote communication means may comprise a wireless communications means such as, but not limited to, Bluetooth, SMS, etc.

Conveniently, the health and safety unit can be constructed from any suitable material or combination of material, such as acrylic, fire retardant acrylic, wood, and metal.

The disclosure is not limited to the embodiment(s) described herein but can be amended or modified without departing from the scope of the present disclosure.

It will be appreciated that while the health and safety units in accordance with the disclosure are particularly described with reference to use in a kitchen or galley, they can equally be employed in any location or room, such as within commercial, public or domestic buildings, or in vehicles or vessels, such as but not limited to caravans, boats, aircraft etc. While an example of a housing to which the health and safety units are movably mounted is a kitchen unit, it will also be appreciated that the housings may be free standing, separate units.

The invention claimed is:

1. A health and safety unit, comprising:

a vertically arranged panel having a first side and a second side opposite the first side; and a mounting structure configured to movably mount the panel to a housing, wherein the panel defines a plurality of pockets extending through the first and second sides, wherein each of the plurality of pockets is: (i) dimensioned to receive and support one or more items for storing within the housing, (ii) integrally molded as a single piece with the panel, and (iii) arranged within a separate corresponding aperture defined in the panel, and wherein said panel, when movably mounted to the housing by the mounting structure, is movable between a first position and a second position, wherein the panel and any items received therein are configured to be enclosed within the housing in the first position, and wherein the panel and any items received therein are configured to be accessible in the second position such that the one or more items can be removed from the plurality of pockets for use.

2. The health and safety unit as claimed in claim 1, wherein the vertically arranged panel is configured to be mounted to be slid in and out of the housing in use in a substantially horizontal direction.

3. The health and safety unit as claimed in claim 2, wherein said panel comprises a front face defining a portion of a front face of the housing when the health and safety unit is in the first position.

4. The health and safety unit as claimed in claim 2, wherein at least one of the one or more items is accessible from both the first and second sides of the panel.

5. A health and safety unit as claimed in claim 3, wherein the said item comprises a fire extinguisher.

6. The health and safety unit as claimed in claim 1, wherein the first position is a stowed position and the second position is a deployed position.

7. The health and safety unit as claimed in claim 1, further comprising one or more symbols identifying the health and safety unit and distinguishing it from other furniture or equipment.

8. The health and safety unit as claimed in claim 1, wherein the mounting structure configured to movably mount the vertically arranged panel to the housing comprises one or more drawer runners.

9. The health and safety unit as claimed in claim 1, further comprising a first aid kit.

10. The health and safety unit as claimed in claim 1, further comprising a fire blanket.

11. A health and safety unit, comprising:

a vertically arranged panel having a first side and a second side opposite the first side;

a front facing panel arranged to be orthogonal to the vertically arranged panel; and a mounting structure configured to movably mount the vertically arranged panel to a housing, wherein the vertically arranged panel defines a plurality of pockets extending through the first and second sides, wherein each of the plurality of pockets is: (i) dimensioned to receive and support one or more items for storing within the housing, (ii) integrally molded as a single piece with the panel, and (iii) arranged within a separate corresponding aperture defined in the panel, and wherein said vertically arranged panel, when movably mounted to the housing by the mounting structure, is movable between a first position and a second position, wherein the vertically arranged panel and any items received therein are configured to be enclosed within the housing in the first position, wherein the front facing panel is configured to form a closure panel of the housing in the first position, and wherein the vertically arranged panel and any items received therein are configured to be accessible in the second position such that the one or more items can be removed from the plurality of pockets for use.

12. The health and safety unit as claimed in claim 11, wherein the vertically arranged panel is configured to be mounted to be slid in and out of the housing in use in a substantially horizontal direction.

13. The health and safety unit as claimed in claim 12, wherein the vertically arranged panel comprises a front face perpendicular to the first and second sides, wherein the front facing panel is mounted to the front face.

14. The health and safety unit as claimed in claim 11, wherein at least one of the one or more items is accessible from both the first and second sides of the panel.

15. A health and safety unit as claimed in claim 11, wherein the said item comprises a fire extinguisher.

16. The health and safety unit as claimed in claim 11, wherein the first position is a stowed position and the second position is a deployed position.

17. The health and safety unit as claimed in claim 11, further comprising one or more symbols identifying the health and safety unit and distinguishing it from other furniture or equipment.

18. The health and safety unit as claimed in claim 11, further comprising a first aid kit.

19. The health and safety unit as claimed in claim 11, further comprising a fire blanket.

20. The health and safety unit as claimed in claim 11, wherein the mounting structure configured to movably mount the vertically arranged panel to the housing comprises one or more drawer runners.

* * * * *